US006651972B2

(12) United States Patent
Hsiao et al.

(10) Patent No.: US 6,651,972 B2
(45) Date of Patent: Nov. 25, 2003

(54) DOCUMENT FEEDING APPARATUS

(75) Inventors: Sidney Hsiao, Changhua (TW); Julian Liu, Taipei (TW); Jackly Liu, Taichung (TW); Clark Huang, Taipei (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 10/191,519

(22) Filed: Jul. 10, 2002

(65) Prior Publication Data

US 2003/0090053 A1 May 15, 2003

(30) Foreign Application Priority Data

Nov. 15, 2001 (TW) ..... 90219698

(51) Int. Cl.[7] ..... B65H 3/06

(52) U.S. Cl. ..... 271/114; 271/116; 271/241; 271/245; 271/118; 271/10.12; 271/10.13

(58) Field of Search ..... 271/114, 116, 271/241, 245, 118, 10.12, 10.13

(56) References Cited

U.S. PATENT DOCUMENTS 4,925,062 A * 5/1990 Tsukamoto et al. ..... 271/115
5,755,435 A * 5/1998 Fujiwara ..... 271/4.04
2001/0040338 A1 * 11/2001 Kuo et al. ..... 271/245

* cited by examiner

*Primary Examiner*—Donald P. Walsh
*Assistant Examiner*—Matthew J. Kohner
(74) *Attorney, Agent, or Firm*—Rosenberg, Klein & Lee

(57) ABSTRACT

A document feeding apparatus includes a cam set fixed to a drive shaft and being driven selectively by the drive shaft. The drive shaft selectively rotates in a first direction and a second direction. The cam set includes a first cam, a second cam, and a first one-way clutch. The present invention further includes a one-way gear train fixed to the drive shaft and being driven selectively by the drive shaft; a paper-stopping plate connected with a paper-stopping arm; a pick-up roller fixed to and rotatable with a pick-up shaft; a strip roller fixed to and rotatable with a strip shaft; and a gear train transferring the power from the one-way drive gear set to the pick-up roller and the strip roller. The relative operational relationship between the pick-up arm and the paper-stopping arm is coordinated by the cam set.

11 Claims, 5 Drawing Sheets

DOCUMENT FEEDING APPARATUS

FIELD OF THE INVENTION

The present invention relates to an automatic document feeder (ADF) apparatus used in an office machine, such as a fax machine, a scanner, a printer, a copy machine, or a multi-function peripheral (MFP).

BACKGROUND OF THE INVENTION

It has been generally known a document feeder is used in an office machine, such as a fax machine, a scanner, a printer, a copy machine, or a multi-function peripheral (MFP), to convey the document into the office machine.

In the conventional machine, the document feeder uses the paper-stopping plate to align the lead edge of the document to make sure accurate orientation of the document. Afterwards, the pick-up roller feeds in the document one by one to avoid conveying two or more documents at the same time.

Conventionally, an electromagnetic valve controls the relative operational relationship between the pick-up roller and the paper-stopping plate. However, the drawback of the conventional approach is high cost and the complex mechanism. Therefore, it is desired to provide a document feeding apparatus of simple mechanism and low cost.

SUMMARY OF THE INVENTION

It is an object of the present invention to provide a document feeding apparatus used in the fax machine, the scanner, the copy machine, the printer or the multi-function peripheral.

Another object of the present invention is to provide a document feeding apparatus with simple mechanism.

The present invention includes a cam set fixed to a drive shaft and being driven selectively by the drive shaft. The cam set operates in a first state and a second state. The drive shaft selectively rotates in a first direction and a second direction. The cam set includes a first cam, a second cam, and a first one-way clutch.

The present invention further includes a one-way drive gear set, including a gear and a second one-way clutch, a paper-stopping plate, a paper-stopping arm, a pick-up roller, a pick-up arm, a pick-up shaft, a strip roller, a strip shaft and a gear train. The paper-stopping plate connected pivotally to a paper-stopping arm. The pick-up roller is fixed to and rotatable with the pick-up shaft. The strip roller is fixed to and rotatable with the strip shaft. The gear train transferring the power from the one-way drive gear set to the pick-up roller and the strip roller.

Other features, benefits and advantages of the invention will be apparent from the following detailed description of preferred embodiments taken in conjunction with the accompanying drawing figures

BRIEF DESCRIPTION OF THE DRAWINGS

FIG. 1(*b*) is a side view of the cam set operating in the first state;

FIG. 1(*c*) is a side view of the cam set operating in the second state;

FIG. 2(*b*) is an enlarged side view showing the cam set the present invention;

DETAIL DESCRIPTION OF PREFERRED EXEMPLARY EMBODIMENT

Figure 1A:
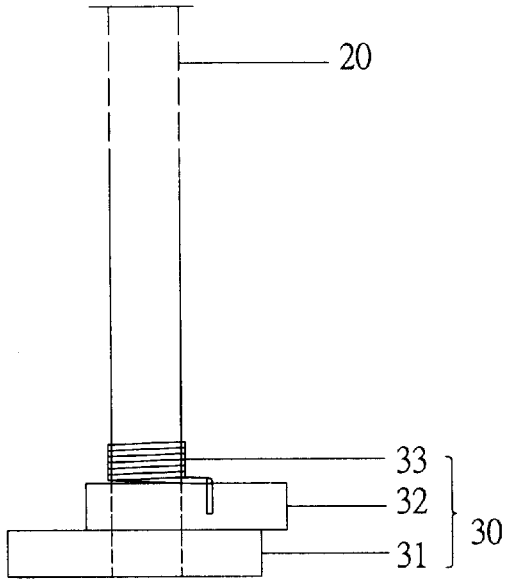
FIG. 1(*a*) is an elevation view of cam set and the drive shaft of the present invention.
Figure 1B:
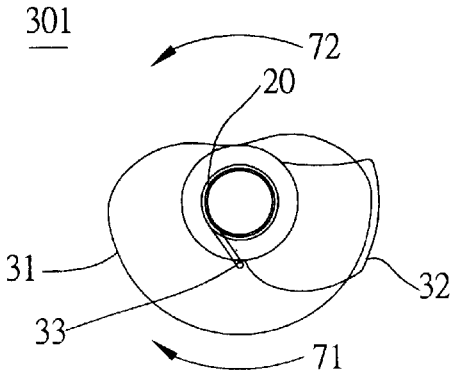
Figure 1C:
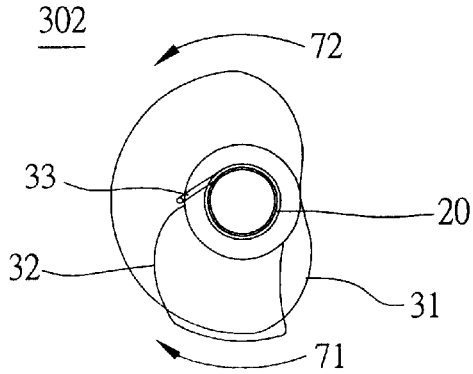

The present invention is used in an office machine to feed the document in simple operation mechanism. Referring to FIG. 1(*a*), the present invention includes a cam set 30 fixed to and rotatable with a drive shaft 20. The drive shaft 20 rotates selectively in a first direction 71 and a second direction 72. The cam set 30 includes a first cam 31, a second cam 32, and a first one-way clutch 33. The first cam 31, the second cam 32 and the first one-way clutch 33 connect to each other. The cam set 30 is selectively driven by the drive shaft 20 to rotate in the first direction 71 and the second direction 72. The cam set 30 operates in a first state 301 and a second state 302, as shown in FIG. 1(*b*) and FIG. 1(*c*). The first direction 71 is opposite to the second direction 72.

Figure 2A:
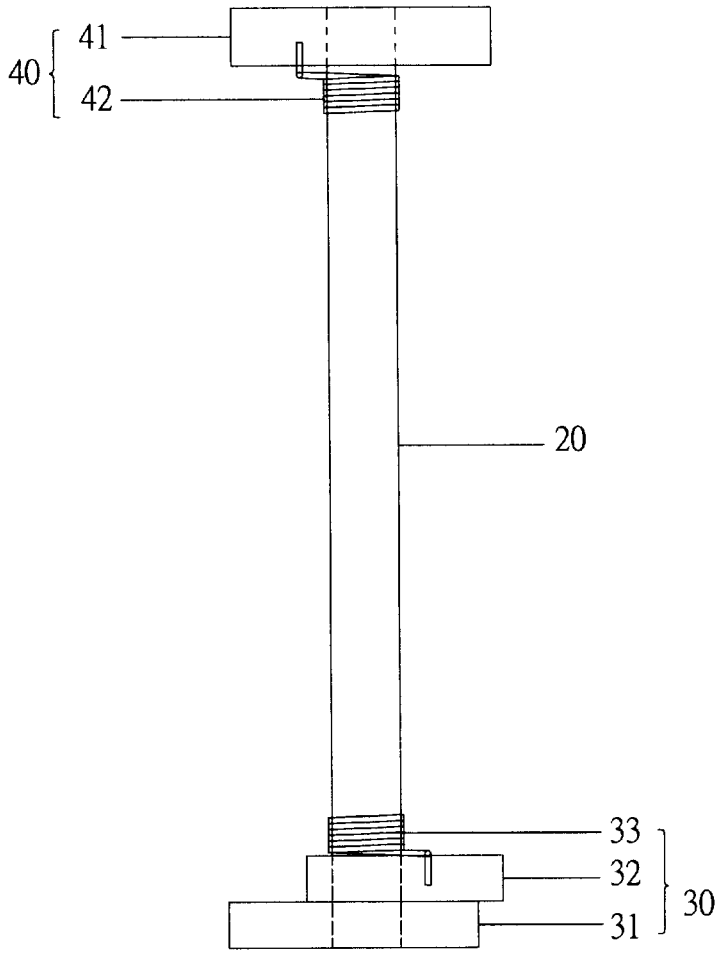
FIG. 2(*a*) is an elevation view showing the cam set, the drive shaft, and the one-way gear set of the present invention.
Figure 2B:
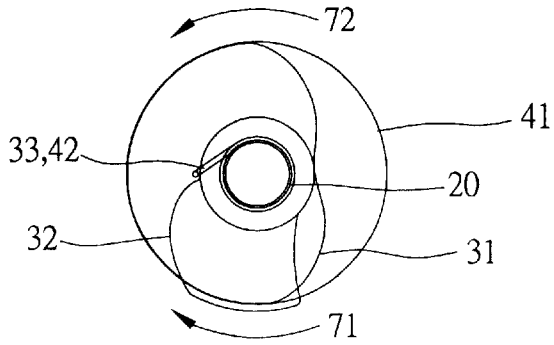

Moreover, referring to FIG. 2(*a*) and FIG. 2(*b*), the present invention further includes a one-way drive gear set 40. The one-way drive gear 40 has a gear 41 connected to a second one-way clutch 42. The one-way drive gear set 40 is fixed to and selectively rotatable with the drive shaft 20 so that the one-way drive gear set 40 selectively rotates in the second direction 72.

Figure 3:
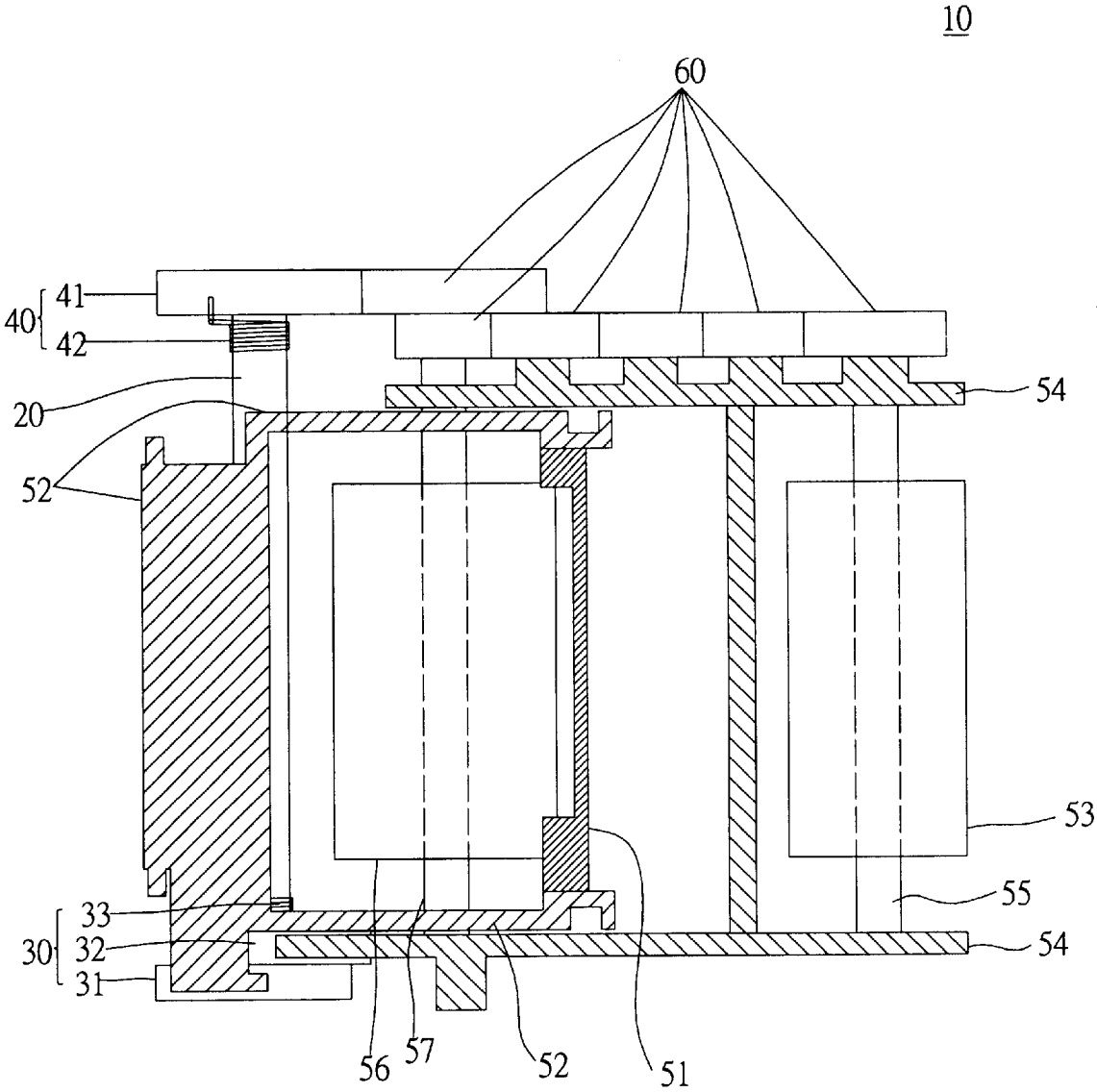
FIG. 3 is an elevation view showing the present invention.
Figure 4:
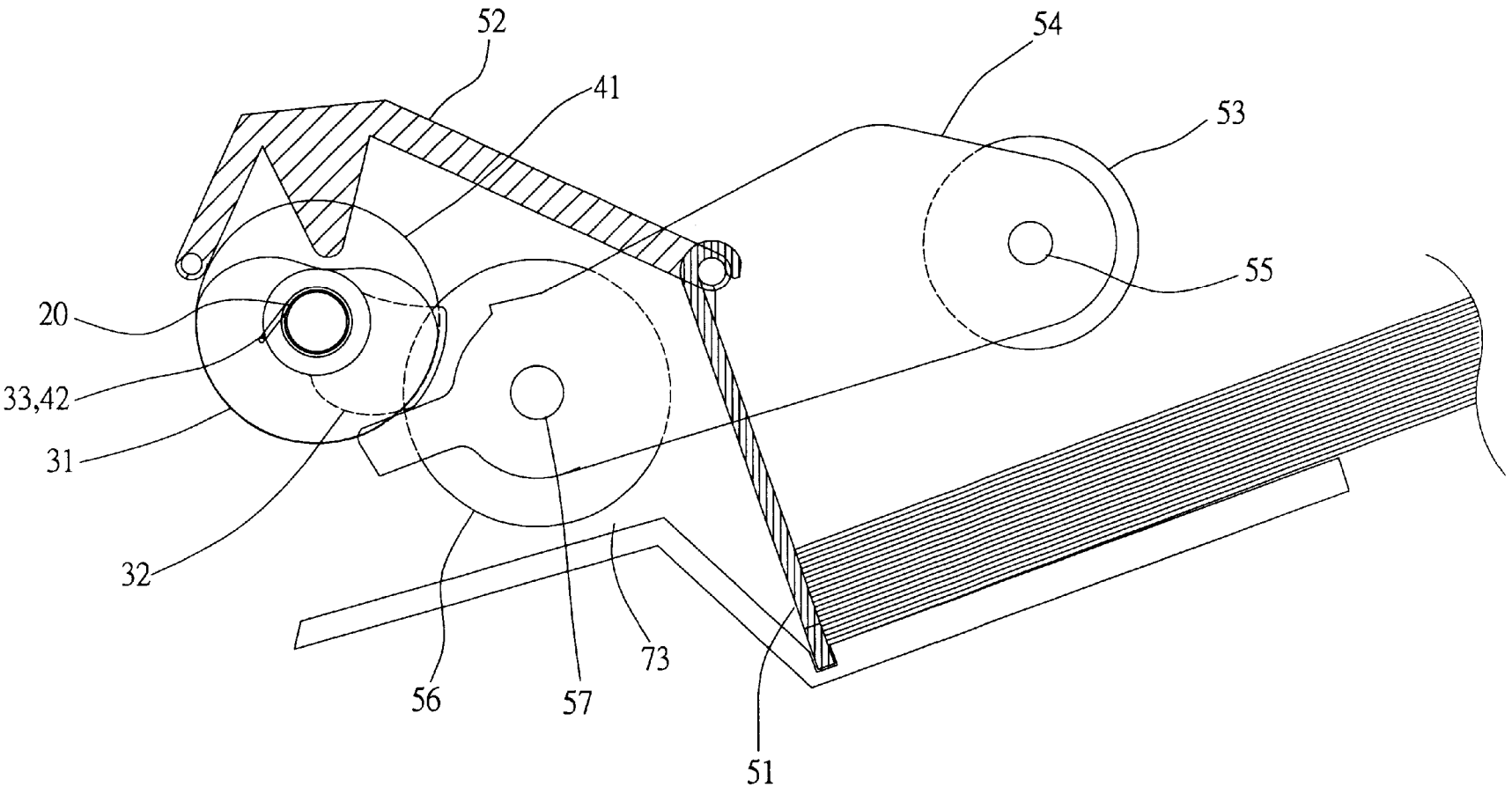
FIG. 4 is a side view showing the present invention.
Figure 5:
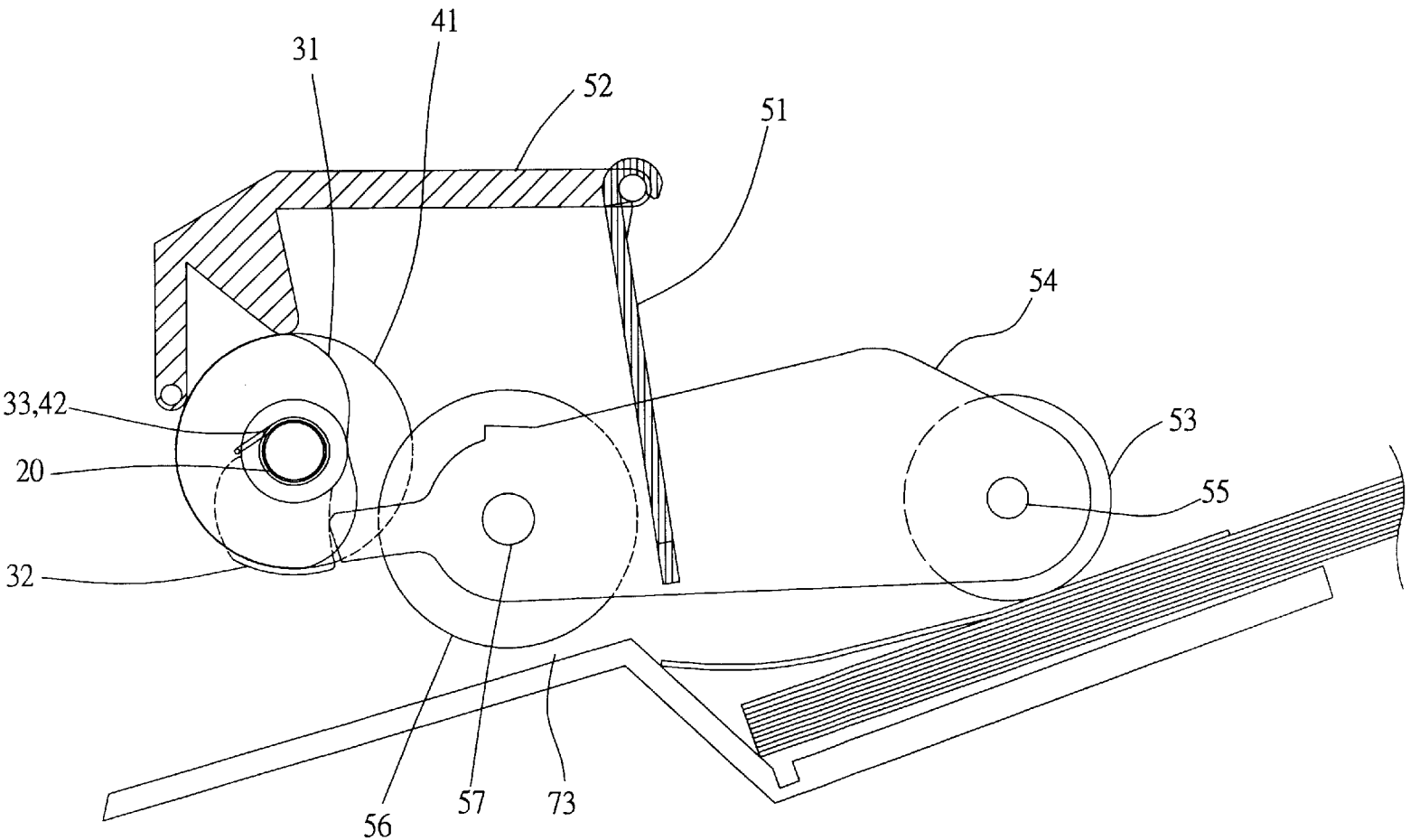
FIG. 5 is an another side view showing the present invention.

As shown in FIG. 3 and FIG. 4, the present invention further includes a paper-stopping plate 51, a paper-stopping arm 52, a pick-up roller 53, a pick-up arm 54, a pick-up shaft 55, a strip roller 56, a strip shaft 57 and a gear train 60. The paper-stopping plate 51 is connected with the paper-stopping arm 52 to align a lead edge of the document and to retard movement of the document. The pick-up roller 53 is fixed to and rotatable with the pick-up shaft 55 to convey selectively the document to a first position 73. The pick-up shaft 55 is connected to the pick-up arm 54. The strip roller 56 is fixed to and rotatable with the strip shaft 57 to convey the document at the first position 73. The strip shaft 57 is connected to the pick-up arm 54. Therefore, the two ends of the pick-up arm 54 are respectively connected to the pick-up roller 53 and the strip roller 56. With respect to the strip shaft 57, the pick-up arm 54 rotates along the strip shaft 57, as shown in FIG. 4 and FIG. 5. The gear train 60 includes a plurality of gears transferring the power of the one-way drive gear set 40 to the pick-up shaft 55 and the strip shaft 57. Therefore, the pick-up roller 53 and the strip roller 56 are driven to rotate to pick up and strip documents, as shown in FIG. 3.

The motion of the cam set 30, as shown in FIG. 4, is described as follows. When the cam set 30 rotates in the first direction 71 to reach the first state 301, the first cam 31 lowers the paper-stopping arm 52 to retard and to align the document by the paper-stopping plate 51. At the same time, the second cam 32 elevates the pick-up arm 54. As shown in FIG. 5, when the cam set 30 rotates in the second direction 72 to reach the second state 302, the first cam 31 elevates the paper-stopping arm 52. At the same time, the second cam 32 lowers one movable end of the pick-up arm 54 to convey the document by the pick-up roller 53. Additionally, the second cam 32 is blocked by one end of the pick-up arm 54 so as to stop rotating resulting in the separation of the drive shaft 20 from the first one-way clutch 33. The pick-up roller 53, shown in FIG. 5, performs the document feed-in operation.

Therefore, the relative operational relationship between the pick-up roller 53 and the paper-stopping plate 51 is coordinated by the cam set 30.

Then, the pick-up roller 53 conveys the document to the first position 73. The strip roller 56 continues conveying the document at the first position 73 forward.

The first one-way clutch 33 is a one-way spring clutch or a one-way bearing clutch. The second one-way clutch 42 is a one-way spring clutch or a one-way bearing clutch.

While the invention has been described in connection with what is presently considered to be the most practical and preferred embodiments, it is to be understood that the invention is not to be limited to the discovered embodiments. The invention is intended to cover various modifications and equivalent arrangement included within the spirit and scope of the appended claims.

What is claimed is:

1. A document feeding apparatus, comprising:

a drive shaft selectively rotating in a first direction and a second direction;

a cam set including a first cam, a second cam, and a first one-way clutch, said cam set fixed to and selectively rotatable with said drive shaft, said first cam, said second cam, and said first one-way clutch connecting to each, said cam set selectively driven by said driven shaft and operating in a first state and a second state;

a one-way drive gear set including a gear and a second one-way clutch, said one-way drive gear set fixed to and selectively rotatable with said drive shaft in said second direction; and a paper-stopping plate connected pivotally to a paper-stopping arm, said paper-stopping plate retarding movement of a document and aligning a lead edge of said document;

wherein said first direction is opposite to said second direction.

2. The document feeding apparatus of claim 1, further comprising a pick-up roller, a pick-up arm and a pick-up shaft, said pick-up roller fixed to and rotatable with said pick-up shaft, said pick-up roller conveying said document to a first position, said pick-up shaft being connected pivotally to said pick-up arm.

3. The document feeding apparatus of claim 2, further comprising a strip roller, and a strip shaft, said strip roller fixed to and rotatable with said strip shaft, said strip roller conveying said document at said first position, said strip shaft being connected to said pick-up arm.

4. The document feeding apparatus of claim 3, further comprising a gear train including a plurality of gears, said gear train transferring a power of said one-way drive gear set to said strip shaft and said pick-up shaft to pick up and stripe said document.

5. The document feeding apparatus of claim 4, wherein said pick-up arm selectively rotates along said strip shaft.

6. The document feeding apparatus of claim 5, wherein, when said cam set rotates in said first direction to operate in said first state, said first cam lowers said paper-stopping arm and said second cam elevates said pick-up arm.

7. The document feeding apparatus of claim 6, wherein, when said cam set rotates in said second direction to operate in said second state, said first cam elevates said paper-stopping arm and said second cam lowers said pick-up arm.

8. The document feeding apparatus of claim 1, wherein said first one-way clutch is a one-way spring clutch.

9. The document feeding apparatus of claim 1, wherein said first one-way clutch is a one-way bearing clutch.

10. The document feeding apparatus of claim 1, wherein said second one-way clutch is a one-way spring clutch.

11. The document feeding apparatus of claim 1, wherein said second one-way clutch is a one-way bearing clutch.

* * * * *